US009468259B2

(12) United States Patent
Ishida et al.

(10) Patent No.: US 9,468,259 B2
(45) Date of Patent: Oct. 18, 2016

(54) SOCK

(71) Applicant: OKAMOTO CORPORATION, Kitakatsuragi-gun, Nara (JP)

(72) Inventors: Manabu Ishida, Nara (JP); Takahiro Araki, Nara (JP); Emi Fujita, Nara (JP)

(73) Assignee: OKAMOTO CORPORATION, Kitakatsuragi-Gun, Nara (JP)

( * ) Notice: Subject to any disclaimer, the term of this patent is extended or adjusted under 35 U.S.C. 154(b) by 89 days.

(21) Appl. No.: 13/785,990

(22) Filed: Mar. 5, 2013

(65) Prior Publication Data

US 2013/0233025 A1 Sep. 12, 2013

(30) Foreign Application Priority Data

Mar. 6, 2012 (JP) ..... 2012-049631

(51) Int. Cl.

| | |
|---|---|
| ***D04B 1/18*** | (2006.01) |
| ***A43B 17/00*** | (2006.01) |
| ***D04B 1/26*** | (2006.01) |
| ***D02G 3/32*** | (2006.01) |
| ***D02G 3/36*** | (2006.01) |

(52) U.S. Cl.

CPC ..... *A43B 17/00* (2013.01); *D02G 3/32* (2013.01); *D02G 3/36* (2013.01); *D04B 1/18* (2013.01); *D04B 1/26* (2013.01)

(58) Field of Classification Search

CPC ..... D04B 1/18; D04B 1/26; A43B 17/00; A41B 11/003; A41B 11/126; A41B 11/121; A41B 11/123

USPC ..... 66/178 R, 182–187, 178 A, 202; 2/240–241

See application file for complete search history.

(56) References Cited

U.S. PATENT DOCUMENTS

| | | | | |
|---|---|---|---|---|
| 2,013,396 | A * | 9/1935 | Adamson | 66/172 E |
| 3,069,883 | A | 12/1962 | Burleson et al. | |
| 3,306,081 | A * | 2/1967 | Miles et al. | 66/178 A |
| 3,537,280 | A * | 11/1970 | Garrou et al. | 66/178 R |
| 3,908,407 | A * | 9/1975 | Brand et al. | 66/172 E |
| 4,520,635 | A * | 6/1985 | Shields et al. | 66/185 |
| 4,525,992 | A * | 7/1985 | Payen | 57/18 |
| 4,571,960 | A * | 2/1986 | Hursh et al. | 66/196 |

(Continued)

FOREIGN PATENT DOCUMENTS

| | | |
|---|---|---|
| GB | 1082223 A | 9/1967 |
| JP | U9-3051367 | 6/1998 |

(Continued)

OTHER PUBLICATIONS

European Search Report issued from the European Patent Office in counterpart European Application No. 13157593.8, dated Jul. 12, 2013, pp. 1-7.

(Continued)

*Primary Examiner* — Danny Worrell

(74) *Attorney, Agent, or Firm* — Nicholas Trenkle; Stites & Harbison, PLLC

(57) ABSTRACT

A sock includes a knitted fabric covering at least from a toe portion to a heel portion of a wearer. The knitted fabric, which is arranged in a first region covering at least sections, in a sole, corresponding to phalanges and metatarsal heads of the wearer, is formed by stitches that are knitted only by means of a covering yarn, which is a winding yarn wrapped around a core yarn.

8 Claims, 9 Drawing Sheets

(56) References Cited

U.S. PATENT DOCUMENTS

| | | | | |
|---|---|---|---|---|
| 5,147,400 | A * | 9/1992 | Kaplan et al. | 623/13.18 |
| 5,319,950 | A * | 6/1994 | Whitt et al. | 66/182 |
| 5,823,014 | A * | 10/1998 | Kobayashi et al. | 66/178 R |
| 6,158,253 | A * | 12/2000 | Svoboda et al. | 66/178 R |
| 6,216,497 | B1 * | 4/2001 | Miyata et al. | 66/202 |
| 6,708,348 | B1 * | 3/2004 | Romay | 2/239 |
| 6,725,691 | B2 * | 4/2004 | Yakopson | 66/178 A |
| 7,114,320 | B2 * | 10/2006 | Niwa et al. | 57/225 |
| 7,152,390 | B2 * | 12/2006 | Weiser et al. | 57/225 |
| 7,895,863 | B2 * | 3/2011 | Smith et al. | 66/172 E |
| 2011/0302699 | A1 * | 12/2011 | Kaneda et al. | 2/239 |
| 2013/0305788 | A1 * | 11/2013 | Atmanspacher | 66/178 A |

FOREIGN PATENT DOCUMENTS

| | | |
|---|---|---|
| JP | 2002-69701 | 3/2002 |
| JP | A-2007-009378 | 1/2007 |
| JP | 2009-056765 A | 3/2009 |
| JP | 2009-287140 | 12/2009 |
| JP | A-2011-074519 | 4/2011 |
| JP | A-2011-256506 | 12/2011 |

OTHER PUBLICATIONS

Office Action mailed Feb. 2, 2016 in Corresponding Japanese Patent Application No. P2012-049631.

* cited by examiner

SOCK

BACKGROUND OF THE INVENTION

1. Field of the Invention

The present invention relates to a sock to be worn on a human body.

2. Related Background Art

There have been proposed socks, such as sports socks and athletic socks, which enhance a motor function of the wearer of the socks. These socks are designed to ease muscle fatigue by assisting a motion of a muscle and the like with an enhanced pressing force applied thereto entirely or partially, or to prevent injury by fixating a motion of a muscle with the help of a taping theory. For instance, as the socks using the taping theory, there are proposed socks in each of which an elastic tightening portion (taping processed portion) is provided at the entire or a partial section between the heel and toes in a circumferential direction (see Japanese Patent Application Publication No. 2002-069701 and Japanese Patent Application Publication No. 2009-287140).

However, the conventional sports socks or athletic socks place importance on assisting or correcting a bodily function of a wearer of the socks. For this reason, these socks are not structured to ease unwanted tightness or to effectively convert the physical ability intrinsic to the wearer, such as the ability to stand firmly on the wearer's feet and the ability to push off the ground with the wearer's feet, into instantaneous force and thrust, to exert these force in the form of athletic performance, when the wearer plays a sport or a game.

SUMMARY OF THE INVENTION

An object of the present invention, therefore, is to provide a sock that facilitates exerting the physical ability intrinsic to a wearer of the sock, as athletic performance, when the wearer plays a sport or a game.

The sock according to the present invention comprises a knitted fabric covering at least from a toe portion to a heel portion of a wearer, wherein the knitted fabric, which is arranged in a first region covering at least sections, in a sole, corresponding to phalanges and metatarsal heads of the wearer, is formed by stitches that are knitted only by means of a covering yarn, which is a winding yarn wrapped around a core yarn.

In order to effectively exert the athletic performance of the wearer when the wearer plays a sport or a game, the physical ability intrinsic to the wearer, such as the ability to stand firmly on the wearer's feet and the ability to push off the ground with the wearer's feet, needs to be effectively converted into instantaneous force and thrust. In the sock having the configuration described in the present application, a region covering the section in the sole corresponding to the phalanges and metatarsal heads of the wearer, which is, in other words, the knitted fabric that is arranged in the first region covering the toe portion on the sole side and a tarsal ball bulging between a base of toes and the foot arch, is formed by stitches that are knitted only using a covering yarn composed of a core yarn and a winding yarn wrapped around the core yarn. Thus, the knitted fabric formed in the first region is thinner than a knitted fabric that is formed by stitches that are knitted using conventional face yarn and back yarn. Thus, when the tarsal ball of the wearer grips the ground and then the toe portion pushes off the ground, the ability to stand firmly on the wearer's feet and the ability to push off the ground with the wearer's feet can be converted into instantaneous force and thrust, as if the wearer is barefooted. Furthermore, because the weight of the sock having the configuration described in the present application is lighter than that of the sock that is configured by a knitted fabric formed by stitches that are knitted using conventional face yarn and back yarn, the physical ability of the wearer can efficiently be converted into athletic performance. As a result, easily exerting the athletic performance of the wearer.

According to the sock of the present invention, the core yarn may be made from polyurethane long fibers of 20 deniers to 100 deniers, and the winding yarn may be a filament yarn having a monofilament diameter of 200 nm to 1000 nm and a total denier number of 20 to 200.

The monofilament diameter described here means a diameter of a cross section of a plurality of filaments configuring a filament yarn. The total number of deniers means a product of the number of deniers and the number of filaments in a single filament configuring the filament yarn.

In this sock, forming the winding yarn using a plurality of filaments having an extremely small diameter of 200 nm to 1000 nm generates great frictional force between the winding yarn and a part that is in contact with the winding yarn (a skin surface or footwear). Moreover, the exposed winding yarn on a rear surface of the sock (the skin surface side) and a front surface of the sock (the side opposite to the skin surface side) can reduce slippage between the skin surface and the sock when the sock is worn, as well as slippage between the sock and the footwear. Therefore, when running or walking, the gripping force between the sock and the skin and the gripping force between the sock and the footwear can be maintained, and the physical ability of the wearer can efficiently be converted into athletic performance. The sock can also bring an advantage of preventing itself from slipping when the wearer wears the sock.

Because a yarn with appropriate elasticity is used as the core yarn in this sock, the sock fits the foot of the wearer well and can follow the movement of the foot when the wearer takes exercise, providing an affinity between the skin and the sock.

In the sock according to the present invention, a knitted fabric that is arranged in a second region covering at least a part of an instep of the wearer may be formed by stitches that are knitted only by means of the covering yarn, which is a winding yarn wrapped around a core yarn.

The weight of this sock can be further reduced. By reducing the weight of the sock, the physical ability intrinsic to the wearer can efficiently converted into athletic performance. In addition, by using the knitted fabric having the above-described configuration as the knitted fabric arranged in the second region, the part of the sock that comes into contact with the instep of the wearer can be made more breathable, providing excellent quick-drying properties.

In the sock according to the present invention, the core yarn of the stitches forming the knitted fabric arranged in the second region may be made from polyurethane long fibers of 20 deniers to 100 deniers, and the winding yarn may be made from crimped nylon or polyester long fibers of 20 deniers to 200 deniers.

The inventors of the present application have found that, when forming the knitted fabric of the second region by using the stitches that are knitted only using the covering yarn, the shape of the sock can be maintained easily by using a core yarn that has approximately the same number of deniers as the core yarn of the stitches forming the knitted fabric of the first region. According to the sock having the configuration described in the present application, because the core yarn of the stitches forming the knitted fabric of the first region has approximately the same number of deniers as the core yarn of the stitches forming the knitted fabric of the second region, the shape of the sock can be maintained easily.

In the sock according to the present invention, the knitted fabric arranged in the first region may have an expansion/contraction ratio in a foot length direction of 100% to 200%.

In this sock, the elongation percentage of the knitted fabric arranged in a part covering the sole of the wearer is greater than that of the skin of the wearer during exercise. Therefore, the elongation of the knitted fabric can follow the movement of the foot even when the wearer plays an intense game, preventing the wearer from being disturbed physically and mentally.

In the sock according to the present invention, a static friction coefficient A of the knitted fabric arranged in the first region with respect to an insole may be set at 0.6 or higher, a static friction coefficient B of the same with respect to the sole of the wearer may be set at 1.0 or higher, and the static friction coefficient A may be set to be smaller than the static friction coefficient B.

This sock can reduce slippage between the skin surface and the sock and between the sock and the footwear. This sock can therefore exert sufficient gripping force even when the wearer plays an intense game. The sock having the configuration described in the present application can ensure stronger thrust of pushing off the ground, compared to a conventional running sock.

In addition, in the sock according to the present invention, first to fifth pouch portions for accommodating first to fifth toes of the wearer respectively may be formed in a section covering the toe portion.

According to this sock, because the first to fifth toes can move independently and therefore can grip a wide ground upon landing, the physical ability of the wearer can effectively be converted into instantaneous force and thrust, facilitating exerting the athletic performance of the wearer.

In the sock according to the present invention, a knitted fabric in the toe portion that covers a distal section extending from the sole to the instep across tips of the toes of the wearer may be formed by stitches that are knitted only by means of the covering yarn, which is a winding yarn wrapped around a core yarn.

According to this sock, the physical ability of the wearer, running or walking, can reliably be converted into athletic performance, until the wearer eventually pushes off the ground.

In the sock according to the present invention, a reinforcing yarn may be inserted in a knitted fabric covering the vicinity of a distal portion of the toe portion.

This sock can prevent breakage of the vicinity covering the distal portion of the toe portion where a load or friction is applied when the wearer runs or walks.

The sock according to the present invention can effectively facilitate exerting the physical ability intrinsic to the wearer as athletic performance, when the wearer plays a sport or a game.

DESCRIPTION OF THE PREFERRED EMBODIMENTS

Figure 1:
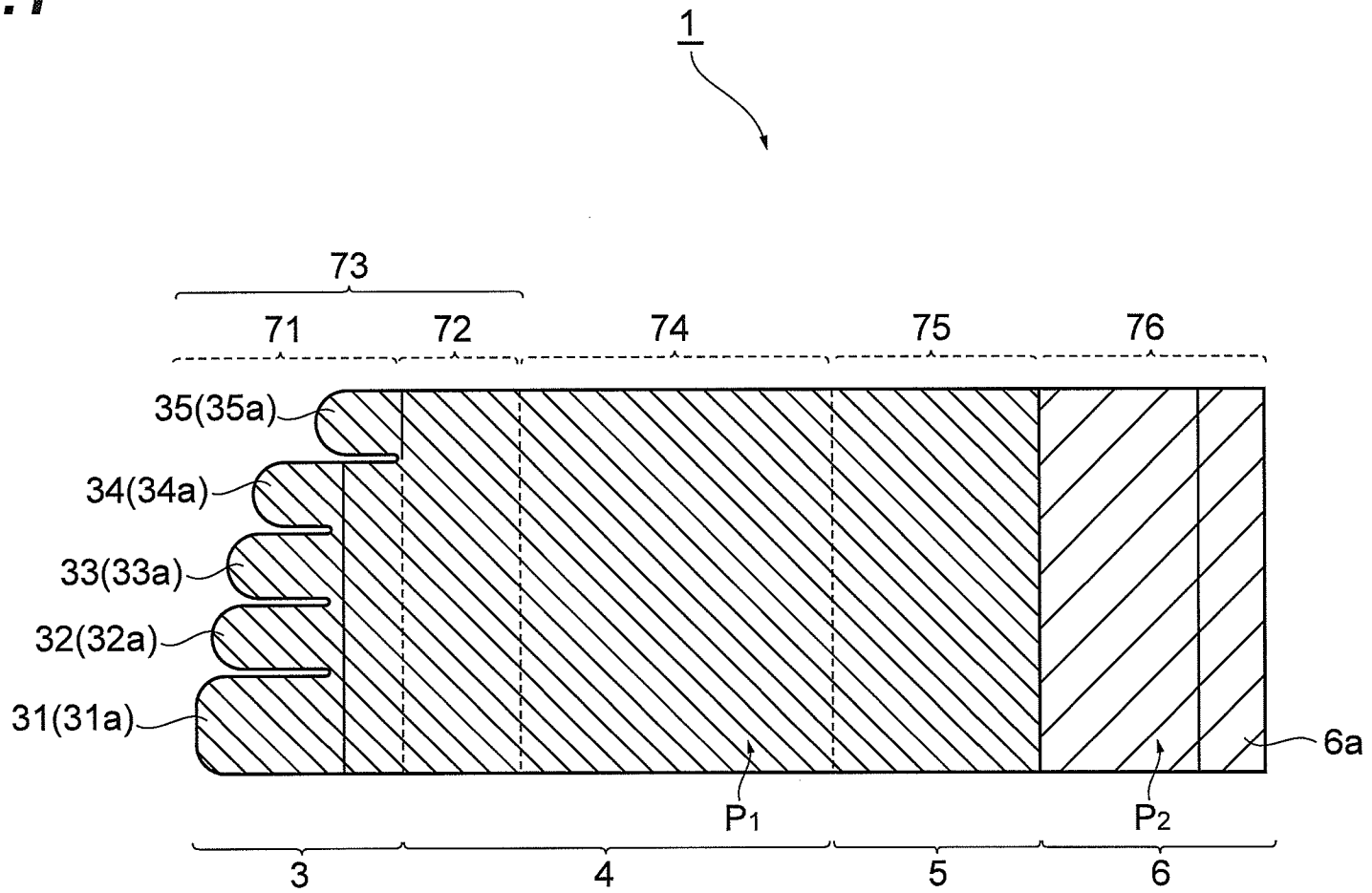
FIG. 1 is a bottom view showing a sock according to an embodiment of the present invention.

Preferred embodiments of the present invention are described hereinafter with reference to the drawings. Note that like reference numerals are used to indicate the same or like portions in each of the diagrams. The dimensional ratios shown in the diagrams are not necessarily consistent with those described herein. Moreover, the terms indicating the directions such as "top" and "bottom" are used conveniently based on the conditions illustrated in the diagrams.

Figure 2:
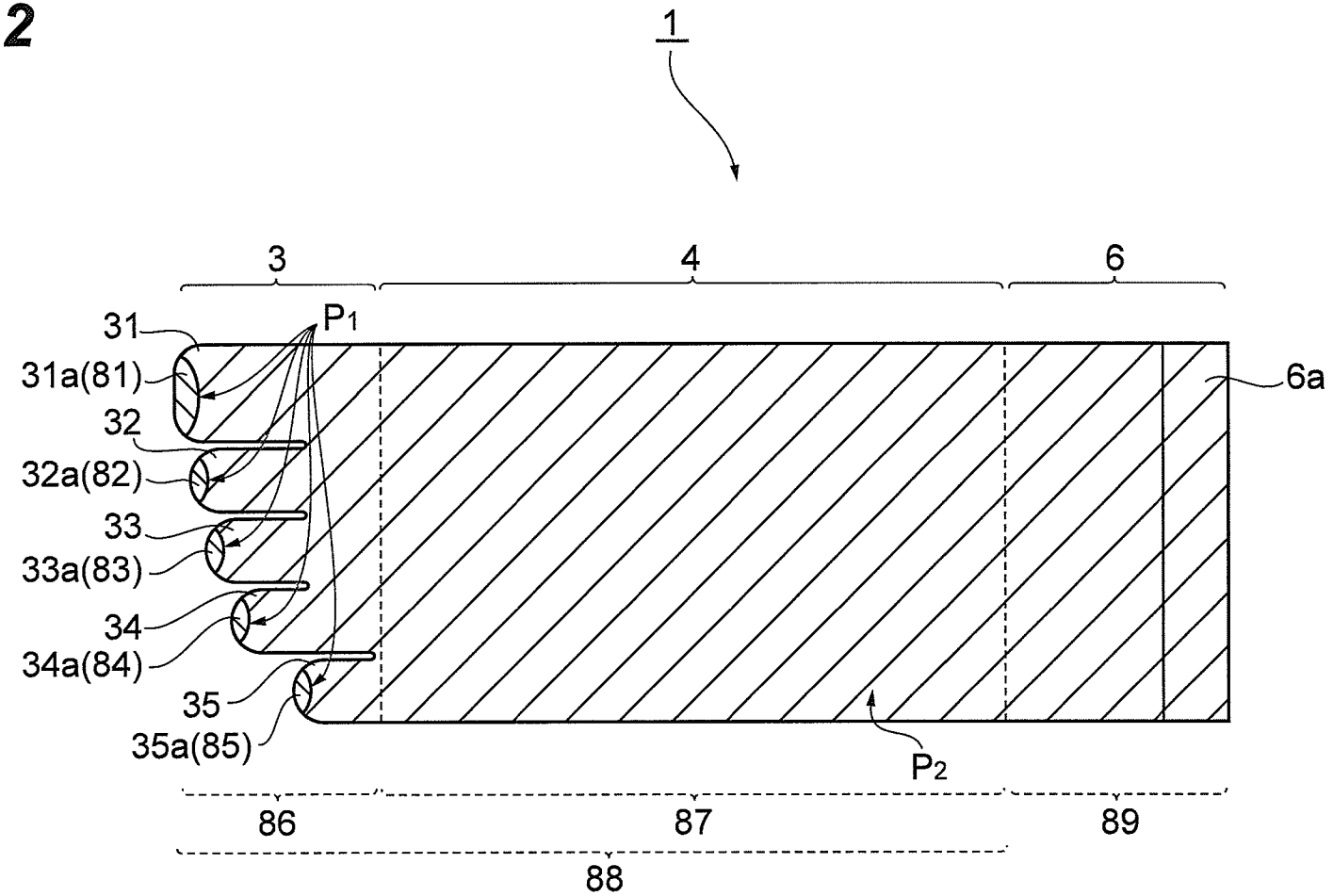
FIG. 2 is a plan view showing the sock according to the embodiment of the present invention.

FIG. 1 is a bottom view showing a sock according to an embodiment of the present invention. FIG. 2 is a plan view showing the sock according to the embodiment of the present invention. A sock 1 according to the present embodiment is a so-called "ankle-length sock" covering an ankle of a wearer thereof. The sock 1 can be knitted using, for example, Whole Garment® flat-knitting machine produced by Shima Seiki MFG., Ltd.

As shown FIGS. 1 and 2, the sock 1 has a toe portion 3 covering toes of the wearer, a foot portion 4 formed continuously to the toe portion 3 and covering an instep, tarsal ball, and foot arch, a heel portion 5 formed continuously to the foot portion 4 and covering a heel, and a leg portion 6 formed continuously to the heel portion 5 and covering the heel. The toe portion 3 is provided with a first pouch portion 31, a second pouch portion 32, a third pouch portion 33, a fourth pouch portion 34, and a fifth pouch portion 35 for accommodating, respectively, the first toe, the second toe, the third toe, the fourth toe, and the fifth toe of the wearer. An opening end portion (a right end shown in FIGS. 1 and 2) of the leg portion 6 is provided with an opening rubber portion 6*a*.

Figure 3A:
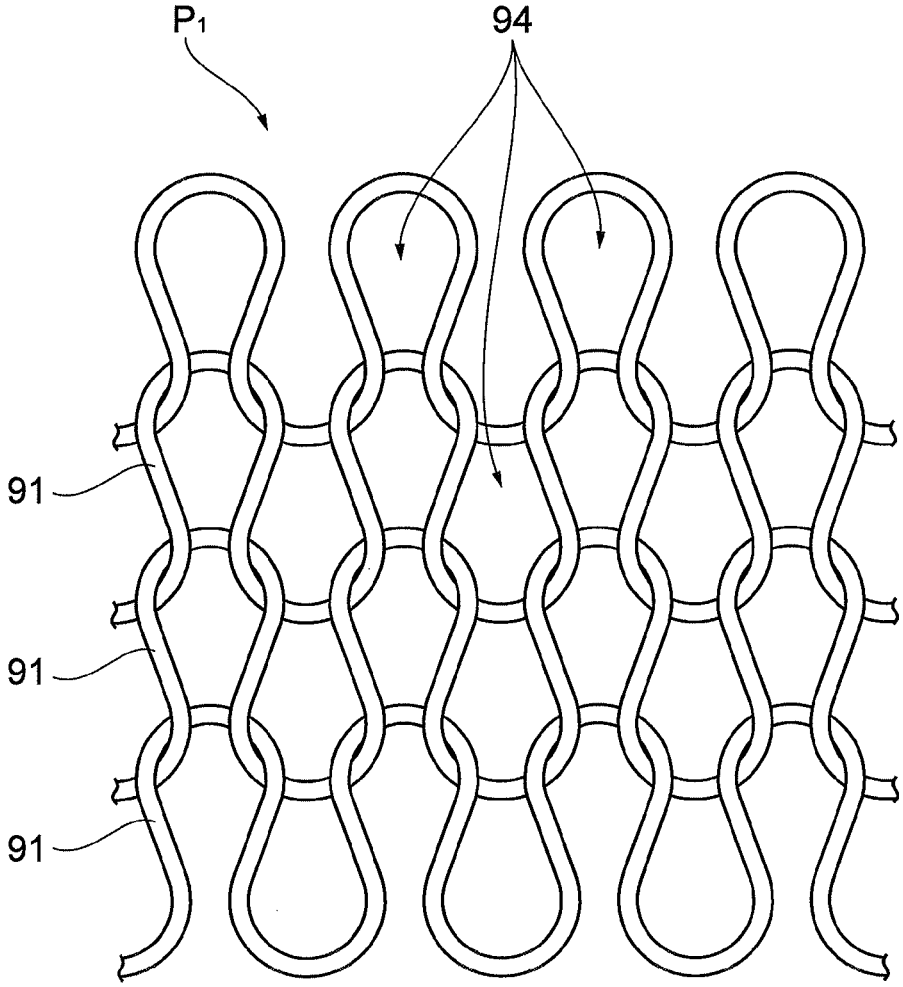
FIG. 3A shows a diagram of a first knitted fabric.
Figure 3B:
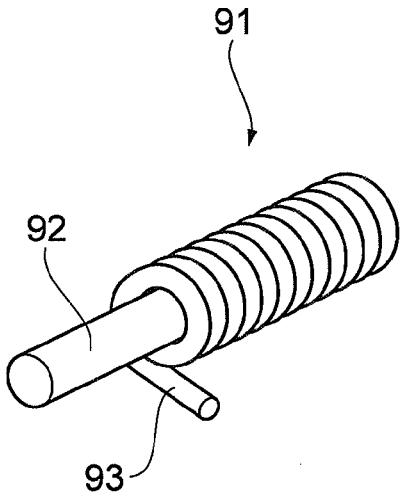
FIG. 3B shows a diagram of a FTY used for knitting stitches of the first knitted fabric.

FIG. 3A is a diagram showing a first knitted fabric. FIG. 3B is a diagram showing a filament twisted yarn (FTY) used for knitting stitches of the first knitted fabric. In the sock 1, a knitted fabric arranged in a first region 73 is formed by stitches 94 that are knitted only using a FTY (covering yarn) 91, which is a winding yarn 93 wrapped around a core yarn 92 (referred to as "first knitted fabric $P_1$" hereinafter), the first region 73 consisting of at least a region 71 that covers a section in a sole corresponding to phalanges B1 (see FIGS. 5 and 6) of the wearer, and a region 72 that covers a section in the sole corresponding to metatarsal heads B2 (see FIGS. 5 and 6) of the wearer, which is, in other words, a region 72 that covers a sole M2 of the toe portion (see FIGS. 5 and 6) and a tarsal ball M5 (see FIGS. 5 and 6) bulging between a base of toes M3 (see FIG. 5) and a foot arch M4 (see FIGS. 5 and 6). Note that the first knitted fabric $P_1$ is described in the following paragraphs.

In the sock 1 according to the present embodiment, as shown in FIGS. 1 and 2, the first knitted fabric $P_1$ is configured by knitted fabrics that are arranged in not only the first region 73 consisting of the region 71 that covers the section in the sole corresponding to the phalanges B1 (see FIGS. 5 and 6) of the toe portion 3 and the region 72 that covers the section in the sole corresponding to the metatarsal heads B2 (see FIGS. 5 and 6) of the foot portion 4, but also a region 74 that covers the foot arch M4 (see FIGS. 5 and 6) of the foot portion 4, a region 75 corresponding to the heel portion 5, and regions 81 to 85 that cover distal sections 31*a* to 35*a* extending from the sole of the wearer toward the instep across tips of the toes in the first pouch 31 to the fifth pouch 35.

In the first pouch 31 to the fifth pouch 35, a reinforcing yarn is inserted in the knitted fabrics that are arranged in the regions 81 to 85 that cover the distal sections (vicinity of the distal portions) 31*a* to 35*a* including the tips of the toes of the wearer and extend toward the instep across the tips. Crimped nylon or polyester long fibers, for example, can be used as the reinforcing yarn. The sock 1 having such configuration can prevent breakage of the knitted fabrics of the regions 81 to 85 that cover the distal sections 31*a* to 35*a* of the toe portion 3 where a load or friction is applied when the wearer runs or walks.

Figure 4A:
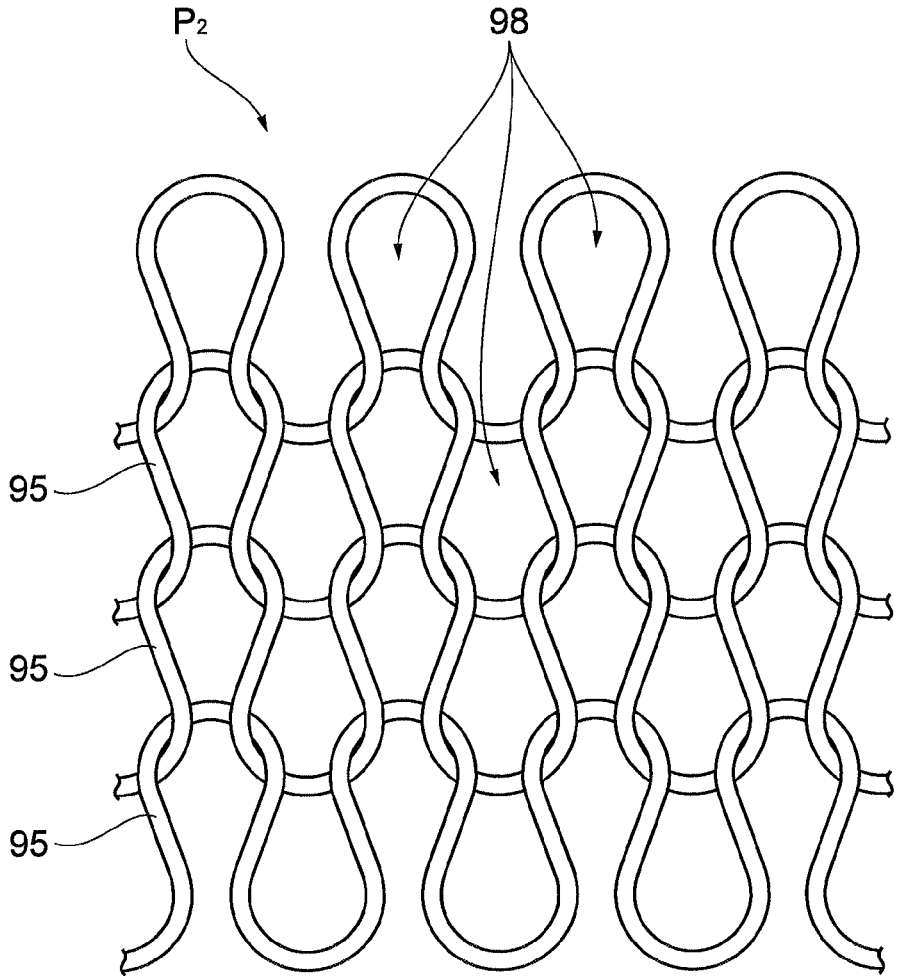
FIG. 4A shows a diagram of a second knitted fabric.
Figure 4B:
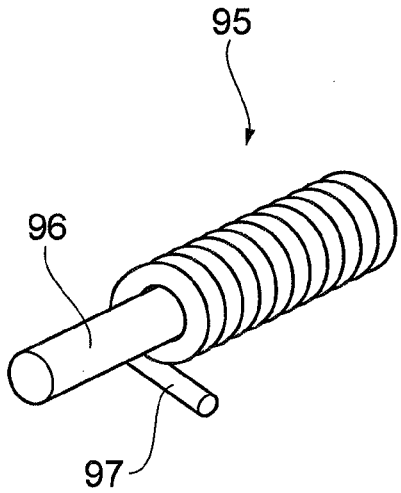
FIG. 4B shows a diagram of a FTY used for knitting stitches of the second knitted fabric.

FIG. 4A is a diagram showing a second knitted fabric. FIG. 4B is a diagram showing a filament twisted yarn (FTY) used for knitting stitches of the second knitted fabric. In the sock 1, at least a knitted fabric that is arranged in a second region 88 covering at least a part of the instep of the wearer is formed by stitches 98 that are knitted only using a FTY (covering yarn) 95, which is a winding yarn 97 wrapped around a core yarn 96 (referred to as "second knitted fabric $P_2$" hereinafter). The FTY 95 is a knittable, highly elastic yarn capable of keeping the elasticity of the core yarn 96 and reducing the friction generated between the core yarn and a guide at the time of knitting. Knitting the knitted fabric using only the FTY 95 can ensure elasticity higher than that obtained when a less elastic spun yarn is used. Note that the second knitted fabric $P_2$ is described in the following paragraphs.

In the sock 1 according to the present embodiment, as shown in FIGS. 1 and 2, the second knitted fabric $P_2$ is configured by knitted fabrics that are arranged in a region 86 covering the instep side of the toe portion 3, a region 87 covering the instep side of the foot portion 4, a region 89 covering the front ankle side of the leg portion 6, and a region 76 covering the back ankle side of the leg portion 6.

The first knitted fabric $P_1$ is now described in detail. The first knitted fabric $P_1$ is formed by the stitches 94 that are knitted only using the FTY 91 composed of the core yarn 92 and the winding yarn 93 wrapped around the core yarn 92, as shown in FIGS. 3A and 3B.

It is preferred that polyurethane long fibers of 20 deniers to 100 deniers be used as the core yarn 92 of the first knitted fabric $P_1$. Also, it is preferred that long fibers (a filament yarn) having a monofilament diameter of 200 nm to 1000 nm and a total denier number of 20 to 200 be used as the winding yarn 93 of the first knitted fabric $P_1$. In the sock 1 according to the present embodiment, polyurethane long fibers of 20 deniers are used as the core yarn 92, and long fibers that are configured by filaments having a monofilament diameter of 700 nm and have a total denier number of 35 are used as the winding yarn 93.

Because the winding yarn 93 is formed by a plurality of filaments having an extremely small diameter of 200 nm to 1000 nm, the contact area between the knitted fabric and a contact surface (skin surface or footwear) increases, generating great frictional force between the winding yarn 93 and the skin surface or footwear of the wearer that is in contact therewith. Moreover, because the winding yarn 93 becomes exposed on a rear surface of the sock (the skin surface side of the wearer) and a front surface of the sock (the footwear side) during the formation of the stitches 94, not only is it possible to reduce slippage between the skin surface and the sock 1 when the sock is worn, but also slippage between the sock 1 and the footwear can be reduced. Therefore, when running or walking, the gripping force between the sock 1 and the skin surface of the wearer and the gripping force between the sock 1 and the footwear can be maintained, and the physical ability of the wearer can efficiently be converted into instantaneous force and thrust, which can eventually be exerted adequately as the athletic performance of the wearer. The sock 1 can also bring an advantage of preventing itself from slipping when the wearer wears the sock 1.

In this sock 1, because the yearn of 20 deniers to 100 deniers is used as the core yarn 92, the sock 1 fits the foot of the wearer well and can follow the movement of the foot, providing an affinity between the foot of the wearer and the sock 1.

Next, the second knitted fabric $P_2$ is described in detail. The second knitted fabric $P_2$ is formed by the stitches 98 that are knitted only using the FTY 95 composed of the core yarn 96 and the winding yarn 97 wrapped around the core yarn 96, as shown in FIGS. 4A and 4B.

It is preferred that polyurethane long fibers of 20 deniers to 100 deniers be used as the core yarn 96 of the second knitted fabric $P_2$. Also, it is preferred that crimped nylon or polyester long fibers of 20 deniers to 200 deniers be used as the winding yarn 97 of the second knitted fabric $P_2$. In the sock 1 according to the present embodiment, polyurethane long fibers of 40 deniers are used as the core yarn 96, and polyester long fibers of 150 deniers are used as the winding yarn 97.

The shape of the sock 1 of the present embodiment can easily be maintained because the core yarns 92 and 96 of the stitches 94 and 98 that configure the first and second knitted fabrics $P_1$ and $P_2$ arranged in the first and second regions have approximately the same number of deniers.

In the sock 1 according to the present embodiment, an expansion/contraction ratio of the first knitted fabric $P_1$ covering the regions 71 to 75 shown in FIG. 1 is set at 100% to 200%. In this sock 1, the elongation percentage of the first knitted fabric $P_1$ is greater than that of the skin of the wearer during exercise. Therefore, the elongation of the first knitted fabric $P_1$ can follow the movement of the foot even when the wearer plays an intense game, preventing the wearer from being disturbed physically and mentally.

In the sock 1 according to the present embodiment, a static friction coefficient A of the first knitted fabric $P_1$ covering the regions 71 to 75 shown in FIG. 1, with respect to an insole of the footwear, is set at 0.6 or higher. A static friction coefficient B of the first knitted fabric $P_1$ with respect to the sole of the wearer is set at 1.0 or higher. The static friction coefficient A is set to be lower than the static friction coefficient B. In other words, greater force acts between the sole and the first knitted fabric $P_1$, which is a source of power, than between the first knitted fabric $P_1$ and the insole of the wearer; thus, great frictional force is required between the sole and the first knitted fabric $P_1$. For this reason, the static friction coefficient B needs to be set at a value higher than the static friction coefficient A. Further, setting these coefficients at values lower than the abovementioned values might result in insufficient frictional force and hence low athletic performance. Thus, slippage between the skin surface of the wearer and the sock 1 and slippage between the sock 1 and the footwear can be reduced, exerting sufficient gripping force even the wearer plays an intense game. As a result, the sock 1 according to the present embodiment can ensure stronger thrust of pushing off the ground, compared to a conventional running sock.

Figure 5:
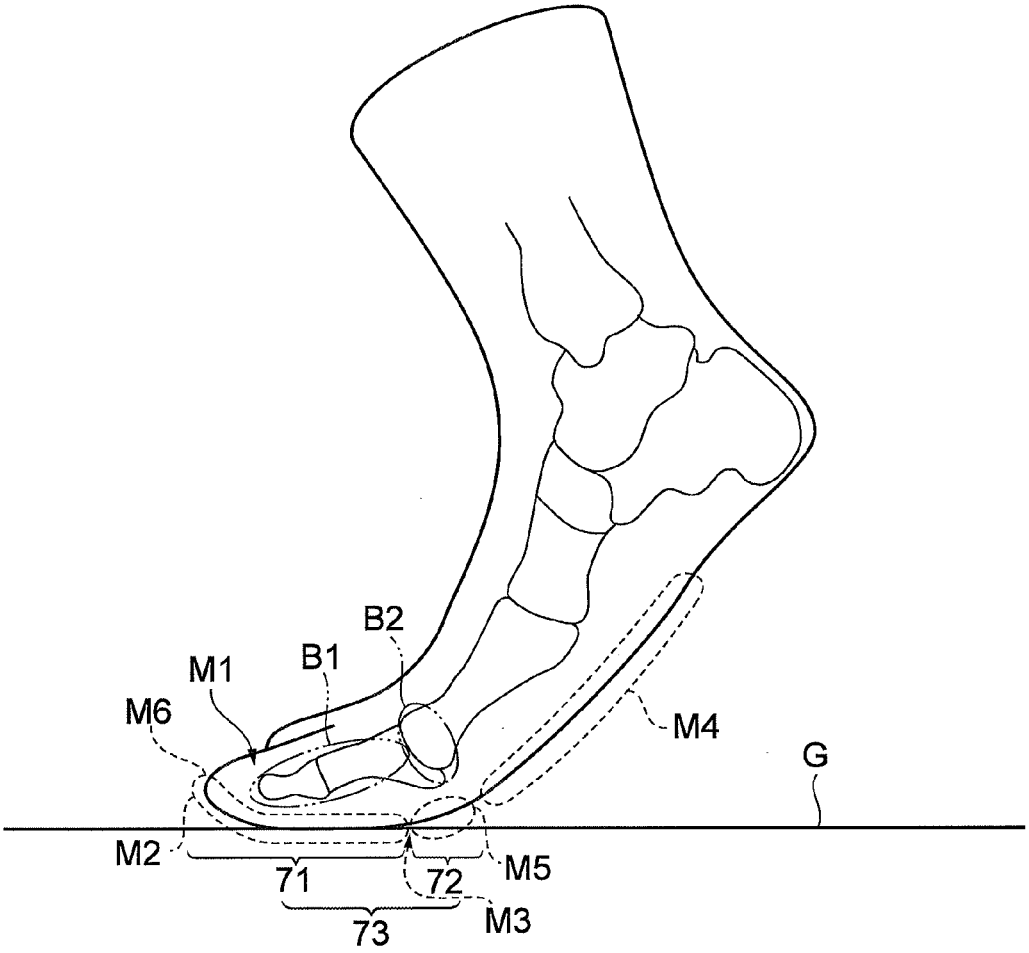
FIG. 5 is an explanatory diagram for illustrating effects of the sock according to the embodiment of the present invention.
Figure 6:
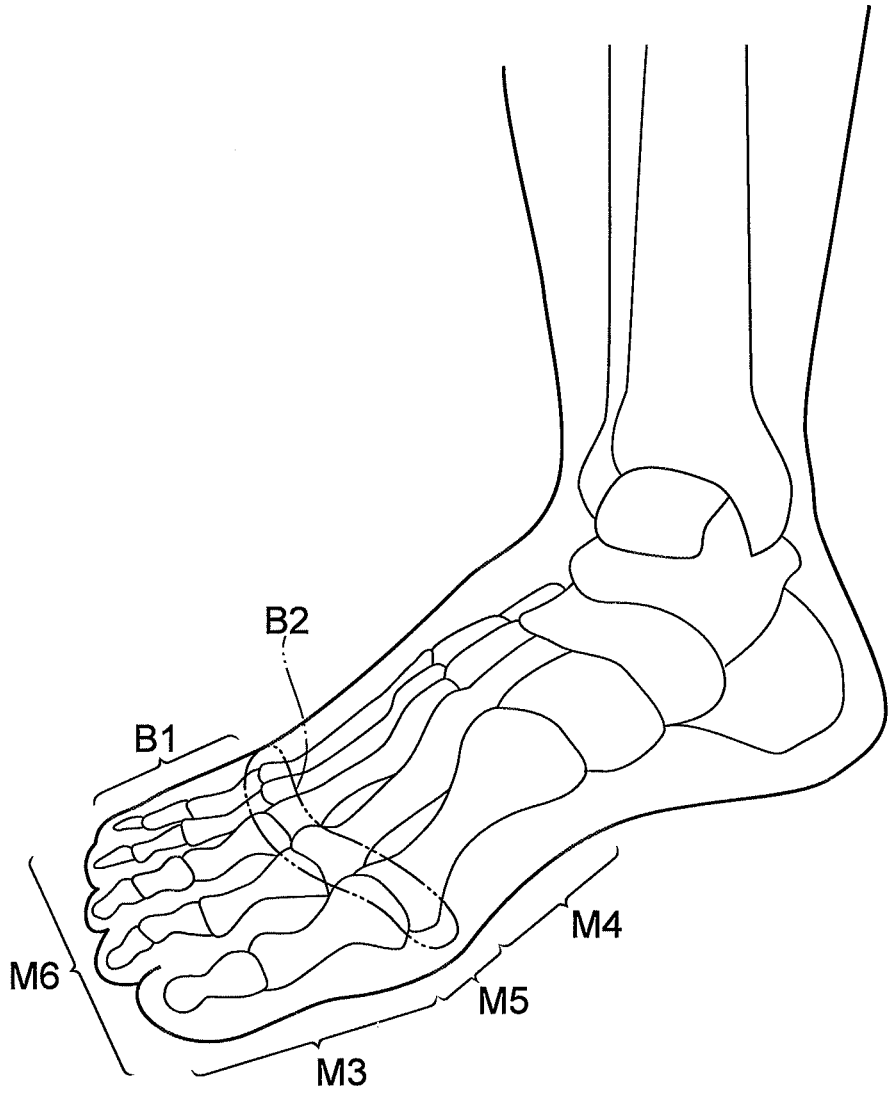
FIG. 6 is an explanatory diagram illustrating the names of parts on bones of a foot and the names of parts on the surface of the foot.

Next, effects of the sock 1 in which the first knitted fabric $P_1$ is arranged in the first region are described using FIGS. 5 and 6. As described above, in order for the wearer to exert his/her athletic performance in a sport or a game, the physical ability intrinsic to the wearer, such as the ability to stand firmly on the wearer's feet and the ability to push off the ground with the wearer's feet, needs to be effectively converted into instantaneous force and thrust.

As shown in FIG. 5, in the sock 1 according to the present embodiment, the first knitted fabric $P_1$ arranged in the first region 73 is formed by the stitches 94 that are knitted only using the FTY 91 composed of the core yarn 92 and the winding yarn 93 wrapped around the core yarn 92 as shown in FIGS. 3A and 3B, the first region 73 consisting of the regions 71 and 72 covering the sections in the sole corresponding to the phalanges B1 and metatarsal heads B2 of the wearer, the regions being the region 71 covering the sole M2 of the toe portion 3 and the region 72 covering the tarsal ball M5 bulging between the base of toes M3 and the foot arch M4.

Figure 9:
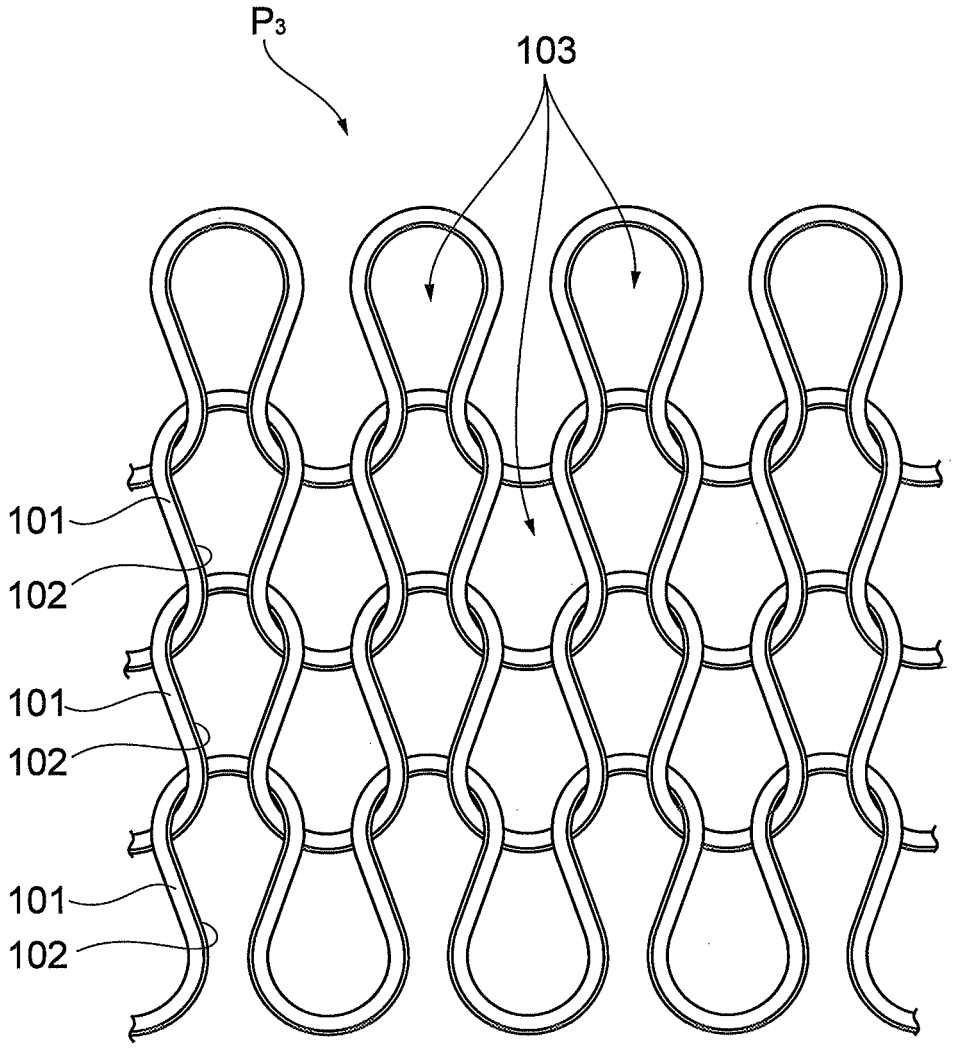
FIG. 9 is a diagram showing a fabric included in another embodiment of the present invention.

Therefore, the first knitted fabric $P_1$ formed in the first region 73 is thinner than a knitted fabric $P_3$ that is formed by stitches 103 knitted using conventional face yarn 101 and back yarn 102 shown in FIG. 9. Accordingly, as shown in FIGS. 5 and 6, when the tarsal ball M5 grips the ground G and then the tips of the toes M6 of the toe portion push off the ground, the ability to stand firmly on the wearer's feet and the ability to push off the ground with the wearer's feet can be transmitted to the ground G and converted into instantaneous force and thrust, as if the wearer is barefooted. Furthermore, because the weight of the sock 1 of the present embodiment is lighter than that of a sock that is configured only by the knitted fabric $P_3$ formed by the stitches 103 knitted using the conventional face yarn 101 and back yarn 102, the physical ability of the wearer can efficiently be converted into athletic performance. As a result, when the wearer plays a sport or a game, the physical ability intrinsic to the wearer can effectively be converted into instantaneous force or thrust, easily exerting the athletic performance of the wearer.

The effects of the socks 1 according to the above-described embodiment are described hereinafter with reference to the following Experiments 1 and 2. However, the present invention is not limited to the examples illustrated in Experiments 1 and 2.

Experiment 1

Figure 7:
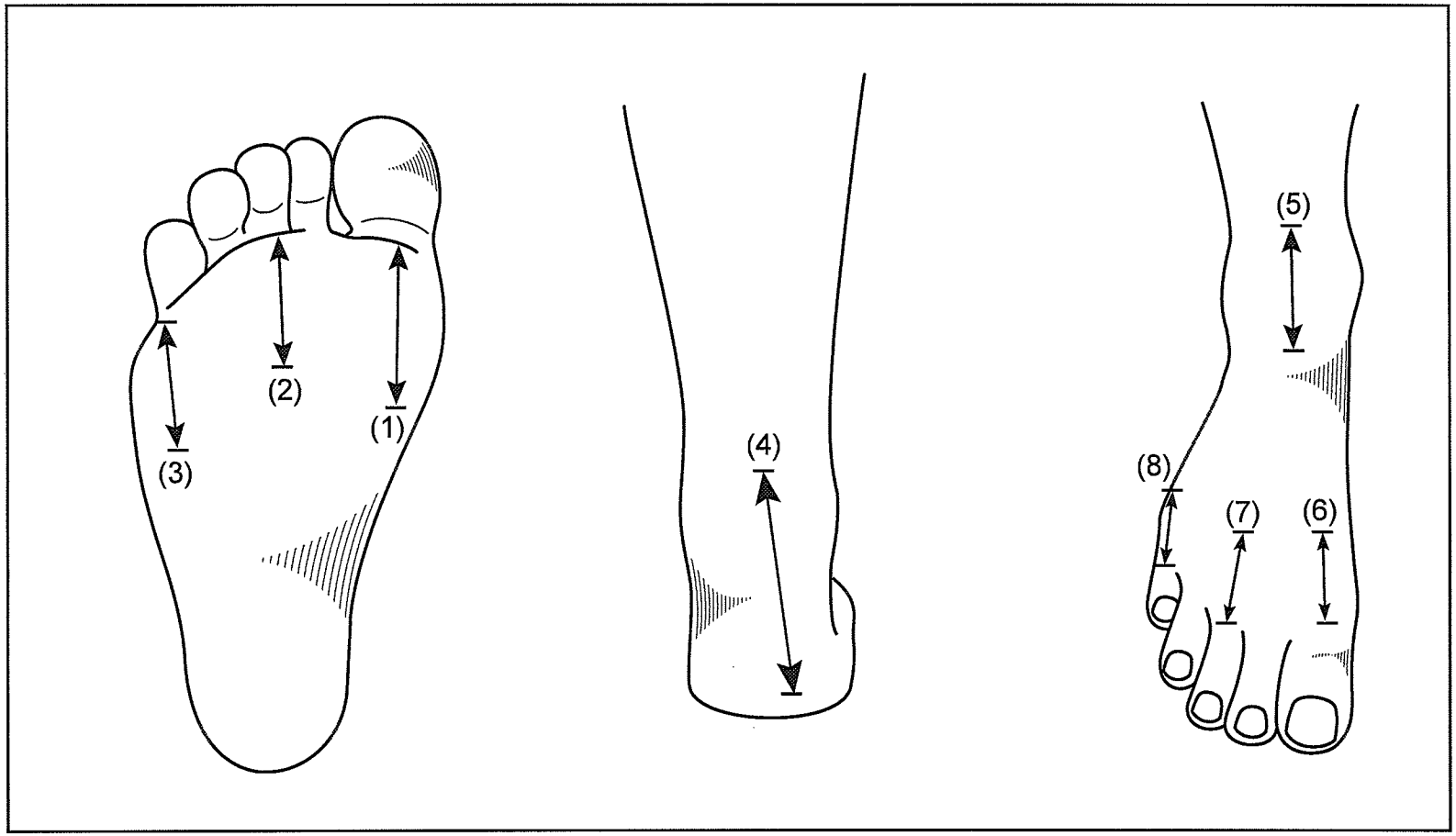
FIG. 7 is an explanatory diagram for illustrating a sections measured in Experiment 1.

In Experiment 1, with the sock 1 of the above-described embodiment and a conventional running sock, elongation of the skin that is caused during exercise and elongation of the fabrics that is caused when the wearer takes exercise with the sock 1 on are measured at eight measurement sections (1) to (8) shown in FIGS. 7A to 7C. Note that the measurement sections (1) to (8) shown in FIGS. 7A to 7C are as follows.

(1) Section in the sole corresponding to the metatarsal heads (an inner part in a width direction)

(2) Section in the sole corresponding to the metatarsal heads (a substantially central part in the width direction)

(3) Section in the sole corresponding to the metatarsal heads (an outer part in the width direction)

(4) Back section between the heel portion and the leg portion (5) Front section of the leg portion (6) Section in the instep corresponding to the metatarsal heads (an inner part in the width direction)

(7) Section in the instep corresponding to the metatarsal heads (a substantially central part in the width direction)

(8) Section in the instep corresponding to the metatarsal heads (an outer part in the width direction)

The conventional running sock was formed by a knitted fabric that is configured by stitches knitted using a face yarn and a back yarn. A spun yarn of 32-count single yarn made of cotton/acrylic was used as the face yarn, and a FTY that uses polyurethane long fibers of 30 deniers as the core yarn and polyester long fibers of 75 deniers as the winding yarn was used as the back yarn. The regions covering the vicinities of the tips of the toes, the heel portion, and the metatarsal heads were formed by pile stitch. The region covering the vicinity of the foot arch was provided with a support (a tightening portion). The rest were formed by flat knitting.

In the first knitted fabric $P_1$ configuring the sock 1 of the above-described embodiment, the stitches 94 were knitted only using the FTY 91. Polyurethane fibers of 20 deniers were used in the core yarn, and long fibers that are configured by filaments having a diameter of 700 nm and have a total denier number of 35 were used in the winding yarn. In the second knitted fabric $P_2$, the stitches 98 were knitted only using the FTY 95. Polyurethane long fibers of 40 deniers were used in the core yarn 96, and crimped polyester long fibers of 50 deniers were used in the winding yarn 97.

Figure 8A:
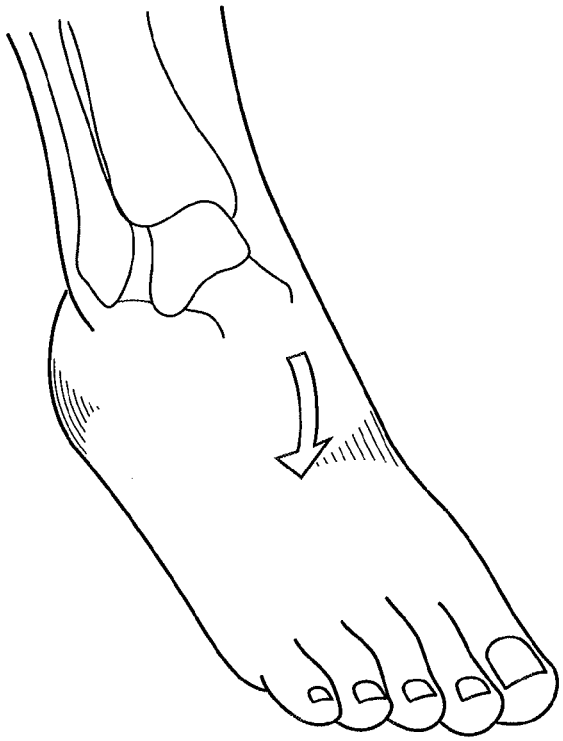
FIG. 8A is an explanatory diagram for illustrating Experiment 1.
Figure 8B:
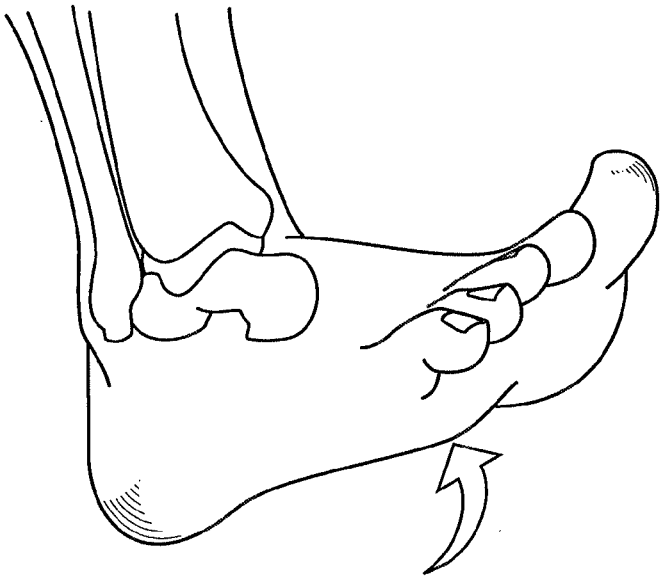
FIG. 8B is an explanatory diagram for illustrating Experiment 1.

Elongation of the skin of the wearer was measured at each of the sections (1) to (8) described above, and elongation of the knitted fabrics covering the regions corresponding to these sections were measured (how much percentage these sections have elongated from the original states) for the sock 1 of the above-described embodiment and the conventional running sock. In so doing, plantar flexion of the foot shown in FIG. 8A and dorsiflexion of the foot shown in FIG. 8B were simulated as the motions of the foot during exercise. With regard to (4) the back section between the heel portion and the leg portion and (5) the front section of the leg portion, the difference between the greater values of the absolute elongations was calculated (i.e., plantar flexion in case of (4) and dorsiflexion in case of (5)). Table 1 below shows the calculation results.

TABLE 1

| Measurement Sections | Elongation of Skin (%) | | Elongation of Corresponding Section (%) | Difference with Skin (%) |
|---|---|---|---|---|
| | Elongation (%) | Motion | | |
| | | | Conventional Running Sock (Comparative Example) | |
| (1) | +32 | Dorsiflexion | 23 | −9 |
| (2) | +28 | Dorsiflexion | 26 | −2 |
| (3) | +24 | Dorsiflexion | 20 | −4 |
| (4) | +15, −21 | Dorsiflexion, Plantar Flexion | 50 | +29 |
| (5) | +27, −47 | Plantar Flexion, Dorsiflexion | 54 | +7 |

TABLE 1-continued

| Measurement Sections | Elongation of Skin (%) Elongation (%) | Motion | Elongation of Corresponding Section (%) | Difference with Skin (%) |
|---|---|---|---|---|
| (6) | −29 | Dorsiflexion | 28 | −1 |
| (7) | −27 | Dorsiflexion | 33 | +6 |
| (8) | −20 | Dorsiflexion | 26 | +6 |
| | | | Sock of the Present Embodiment (Example) | |
| (1) | +32 | Dorsiflexion | 100 | +68 |
| (2) | +28 | Dorsiflexion | 107 | +79 |
| (3) | +24 | Dorsiflexion | 125 | +101 |
| (4) | +15, −21 | Dorsiflexion, Plantar Flexion | 170 | +149 |
| (5) | +27, −47 | Plantar Flexion, Dorsiflexion | 170 | +123 |
| (6) | −29 | Dorsiflexion | 142 | +113 |
| (7) | −27 | Dorsiflexion | 142 | +115 |
| (8) | −20 | Dorsiflexion | 142 | +122 |

It was confirmed in the conventional running sock that the elongations (expansion/contraction ratios) of the measurement sections (1), (2), (3), (6) were lower than the elongation (expansion/contraction ratio) of the skin. It is, therefore, understood that the elongation of the knitted fabric corresponding to each section cannot follow the elongation of the skin during exercise, causing a stretched feeling and causing the knitted fabrics to slide down.

Contrary to these results, it was confirmed in the sock 1 of the present embodiment that the elongations (expansion/contraction ratios) of all the measurement sections (1) to (8) were greater than the elongation (expansion/contraction ratio) of the skin. It is, therefore, proven that all of the knitted fabrics of the sock 1 of the present embodiment can follow the motions of the foot even when the wearer plays an intense game, preventing the wearer from being disturbed physically and mentally.

Experiment 2

In Experiment 2, the static friction coefficient of a knitted fabric arranged in the section covering the sole of the wearer, with respect to the insole of the footwear, and the static friction coefficient of the same knitted fabric with respect to the sole of the wearer (skin surface of the back of the foot), were measured for each of the following socks (A) to (C) (referred to as "sample" hereinafter). Specifically, each of the samples ((A) to (C)) was mounted on a 5 cm×5 cm board, which was then placed on (a) an insole produced by ASICS Corporation and (b) the skin surface of the back of the foot, and then a load (1.73 kg/25 $cm^2$) was applied to each of these obtained sample products. In this state, each of the samples ((A) to (C)) mounted on the 5 cm×5 cm board was pulled in one direction, and resultant stresses (maximum static friction coefficients) were measured, to calculate the static friction coefficients (stress/load). A tensile testing machine (produced by Imada Co., Ltd.: Digital Force Gauge ZP50N) was used for the stress measurement. Each of the samples was measured ten times, and the average value of the results was calculated. The results are shown in Table 2 below.

(A) The sock 1 of the present embodiment and (B) the conventional running sock were the same between Experiment 1 and Experiment 2. (C) A conventional casual sock was formed by knitted fabrics that are configured by stitches knitted using a face yarn and a back yarn. A spun yarn of 32-count single yarn made of cotton/acrylic was used as the face yarn, and a FTY that uses polyurethane long fibers of 30 deniers as the core yarn and polyester long fibers of 75 deniers as the winding yarn was used as the back yarn. In the conventional running sock, a spun yarn of 32-count single yarn made of cotton/acrylic was used as the face yarn, and a FTY that uses polyurethane long fibers of 30 deniers as the core yarn and polyester long fibers of 75 deniers as the winding yarn was used as the back yarn. The regions covering the entire sole and instep were formed by flat knitting.

(A) Sock 1 of the present embodiment
(B) Conventional running sock
(C) Conventional casual sock

TABLE 2

| | (a) Insole | | (b) Skin surface of back of foot | |
|---|---|---|---|---|
| | Stress (kgf) | Static Friction Coefficient | Stress (kgf) | Static Friction Coefficient |
| (A) Example | 1.27 ± 0.06 | 0.74 | 2.31 ± 0.06 | 1.33 |
| (B) Comparative Example 1 | 0.81 ± 0.05 | 0.47 | 1.74 ± 0.07 | 1.00 |
| (C) Comparative Example 2 | 0.91 ± 0.04 | 0.53 | 1.54 ± 0.08 | 0.89 |

Considering the relationship between the insole and each of the samples, it was confirmed that the stress and the static friction coefficient of (A) the sock 1 of the present embodiment were higher than those of (B) the conventional running sock and (C) the conventional casual sock. It is, therefore, understood that the anti-slip effect of (A) the sock 1 of the present embodiment is higher than those of the (B) conventional running sock and (C) the conventional casual sock.

Also, considering the relationship between the skin surface of the back of the foot and each of the samples, it was confirmed that the stress and the static friction coefficient of (A) the sock 1 of the present embodiment were higher than those of (B) the conventional running sock and (C) the conventional casual sock. It is, therefore, understood that the anti-slip effect of (A) the sock 1 of the present embodiment is higher than those of the (B) conventional running sock and (C) the conventional casual sock.

Experiment 2 described above has proven that the sock 1 of the present embodiment can secure high thrust of pushing off the ground, compared to the conventional running sock or the conventional casual sock.

One embodiment of the present invention was described above; however, the present invention is not limited to this embodiment, and various modifications can be made without departing from the scope of the present invention.

The sock 1 of the above-described embodiment was illustrated using the first knitted fabric $P_1$ as an example of the fabrics that are arranged in not only the first region 73 consisting of the region 71 that covers the section in the sole corresponding to the phalanges B1 (see FIGS. 5 and 6) of the toe portion 3 and the region 72 that covers the section in the sole corresponding to the metatarsal heads B2 (see FIGS. 5 and 6) of the foot portion 4, but also the other regions (the region 74, the region 75, the distal regions 81 to 85), as shown in FIGS. 1 and 2. However, the present invention is not limited to this embodiment. In the sock according to the embodiment of the invention of the present application, the knitted fabrics arranged in the regions 71 and 72 may be configured by the first knitted fabric $P_1$, and the knitted fabrics arranged in the other regions may be configured in any ways.

For example, in a sock of another embodiment, only the region 71 that covers the section in the sole corresponding to the phalanges B1 (see FIGS. 5 and 6) of the toe portion 3 and the region 72 that covers the section in the sole corresponding to the metatarsal heads B2 (see FIGS. 5 and 6) of the foot portion 4 may each be configured by the first knitted fabric $P_1$, and the knitted fabrics arranged in the other regions (e.g., the regions 74 to 76, the regions 81 to 88) may each be configured by the third knitted fabric $P_3$ that that is formed by the stitches 103 knitted using the face yarn 101 and the back yarn 102 shown in FIG. 9, the face yarn 101 being arranged on the skin surface side of the wearer when the sock 1 is worn, and the back yarn 102 being arranged on the side opposite to the skin surface side. It goes without saying that the first knitted fabric $P_1$ may be arranged selectively in a region other than the first region 73.

For example, a spun yarn of 10 to 60 counts obtained by spinning short fibers made of cotton/acrylic can be used as the face yarn 101 for knitting the stitches 103 of the third knitted fabric $P_3$, and a FTY that uses polyurethane long fibers of 20 to 40 deniers as the core yarn and nylon or polyester long fibers of 30 to 40 deniers as the winding yarn can be used as the back yarn 102.

Even in the sock of such configuration, as shown in FIG. 5, when the tarsal ball M5 grips the ground G and then the tips of the toes M6 of the toe portion push off the ground, the ability to stand firmly on the wearer's feet and the ability to push off the ground with the wearer's feet can be converted into instantaneous force and thrust, as if the wearer is barefooted. Furthermore, because the weight of this sock is lighter than that of the sock that is configured only by the third knitted fabric $P_3$ formed by the stitches 103 knitted using the conventional face yarn 101 and back yarn 102, the physical ability of the wearer can efficiently be converted into athletic performance. As a result, when the wearer plays a sport or a game, the physical ability intrinsic to the wearer can effectively be converted into instantaneous force or thrust, easily exerting the athletic performance of the wearer.

The sock 1 of the above-described embodiment was illustrated using the example in which the FTY 91 for knitting the stitches 94 of the first knitted fabric $P_1$ is configured by the core yarn 92 and the winding yarn 93 wrapped around the core yarn 92 as shown in FIGS. 3A and 3B, the example being configured by a single covering yarn (SCY). However, the present invention is not limited to this example. For instance, a FTY obtained by double-winding a winding yarn around a core yarn, which is, in other words, a double covering yarn (DCY), can be used as the FTY for knitting the stitches 94 of the first knitted fabric $P_1$.

The sock 1 of the above-described embodiment was illustrated as a so-called "ankle-length sock." However, the present invention is not limited thereto. The sock 1 of the above-described embodiment can be applied to a below-the-knee sock, tights, tabi (Japanese socks with split toe), and the like.

What is claimed is:

1. A sock, comprising:

a knitted fabric covering at least from a toe portion to a heel portion of a wearer, and wherein the knitted fabric, which is arranged in a first region covering at least sections, in a sole, corresponding to phalanges and metatarsal heads of the wearer, is formed by stitches that are knitted only via a first covering yarn, which is a winding yarn wrapped directly on and around an elastic core yarn, wherein the winding yarn of the first covering yarn is a filament yarn that is formed by a plurality of filaments and has a filament diameter of 200 nm to 1000 nm and a total denier number of 20 to 200, and wherein the core yarn of the first covering yarn is made from polyurethane long fibers of 20 deniers to 100 deniers.

2. The sock according to claim 1, wherein a knitted fabric, arranged in a second region covering at least a part of an instep of the wearer, is formed by stitches knitted only via a second covering yarn, which is a winding yarn wrapped around a core yarn.

3. The sock according to claim 2, wherein, in the stitches that form the knitted fabric arranged in the second region, the core yarn is made from polyurethane long fibers of 20 deniers to 100 deniers, and the winding yarn is made from crimpled nylon or polyester long fibers of 20 to 200 deniers.

4. The sock according to claim 1, wherein the knitted fabric arranged in the first region has an expansion/contraction ratio in a foot length direction of 100% to 200%.

5. The sock according to claim 1, wherein a static friction coefficient A of the knitted fabric arranged in the first region with respect to an insole is set at 0.6 or higher, a static friction coefficient B of the knitted fabric with respect to the sole of the wearer is set at 1.0 or higher, and the static friction coefficient A is set to be smaller than the static friction coefficient B.

6. The sock according to claim 1, wherein a section covering the toe portion is provided with first to fifth pouch portions for accommodating first to fifth toes of the wearer respectively.

7. The sock according to claim 1, wherein a knitted fabric in the toe portion that covers a distal section extending from the sole to an instep across tips of toes of the wearer is formed by stitches knitted only via a second covering yarn, which is a winding yarn wrapped around a core yarn.

8. The sock according to claim 1, wherein a reinforcing yarn is inserted in a knitted fabric covering a vicinity of a distal portion of the toe portion.

* * * * *